United States Patent [19]

Mielke

[11] 4,302,114

[45] Nov. 24, 1981

[54] ELECTROMAGNETIC WIRE PRINTER

[76] Inventor: Klaus H. Mielke, Rådavägen 82, S-435 00 Mölnlycke, Sweden

[21] Appl. No.: 50,059

[22] Filed: Jun. 19, 1979

[30] Foreign Application Priority Data

Jun. 19, 1978 [SE] Sweden ..... 7806984

[51] Int. Cl.[3] ..... B41J 3/12

[52] U.S. Cl. ..... 400/124; 335/128; 335/275

[58] Field of Search ..... 400/124; 335/175, 187, 335/128, 275

[56] References Cited

U.S. PATENT DOCUMENTS

| | | | |
|---|---|---|---|
| 1,673,024 | 6/1928 | Royal | 335/275 |
| 2,502,842 | 4/1950 | Hickman | 335/275 |
| 3,158,712 | 11/1964 | De Fligue | 335/187 |
| 3,217,640 | 11/1965 | Bradshaw | 400/124 |
| 3,273,087 | 9/1966 | Huckabee | 335/128 |
| 3,505,629 | 4/1970 | Krantwald et al. | 335/275 |
| 3,958,200 | 5/1976 | Mally | 335/275 |
| 3,973,661 | 8/1976 | De Boo et al. | 400/124 |
| 4,008,447 | 2/1977 | Anderson et al. | 335/128 |
| 4,072,224 | 2/1978 | Barnaby et al. | 400/124 |

OTHER PUBLICATIONS

Kochanowsky et al., "Push Pull Wire Driver", IBM Technical Disclosure Bulletin, vol. 21, No. 4, pp. 1335-1336, 9/78.

*Primary Examiner*—William Pieprz

[57] ABSTRACT

A wire printer including a group of substantially straight and parallel printing wires or needles guided at their front end for longitudinal movement towards and away from a printing station. Each of the printing wires is at its rear end connected to one end of an electromagnet armature the other end of which is supported by a flat spring. The armature cooperates with an electromagnet core provided with a winding. The core as well as the armature consist of strips of magnetic material. The core strips as well as the flat springs are mounted on at least one common rod engaging holes in the rear ends of said core strips and flat springs. The front end of each of the flat springs lies clear of the armature strip and serves, in combination with a stationary rest, to provide a force tending to move the front end of the armature strip away from the core strip.

5 Claims, 3 Drawing Figures

28
29
40
37
38
23
24
25
22
21
39
30
31
27
19
26
32
33
20
13
12
9
14
19a
8
28
40
41
29
37
3
4
38
10
15
11
16
5
39
34
35
18
17
36

ELECTROMAGNETIC WIRE PRINTER

BACKGROUND OF THE INVENTION

This invention relates to wire printers comprising a group of substantially straight and substantially parallel printing wires, means for guiding the printing ends of said wires for longitudinal movement towards and away from a printing station, a group of electromagnets each of which is arranged to operate one of said printing wires, means for supporting said electromagnets in a row extending along said group of printing wires, each of said electromagnets comprising a core extending at right angles to the printing wires and having a front end adjacent to said group of printing wires and a rear end remote from said group of printing wires, a winding on said core, an armature extending along said core, means for pivotally connecting said armature to the rear end of said core, a biasing spring tending to move the armature away from the front end of the core, and means for connecting the front end of the armature to the rear end of a corresponding one of said printing wires for imparting said longitudinal movement thereto.

In known printers of the general type above specified, each of the electromagnets forms a structural unit consisting of a U-shaped core and an armature fitted thereon. The units in question are mounted individually on a common base plate. The length (that is, the extension in the direction of the wires) of the electromagnet group and its base plate is comparatively large.

The invention has for its principal aim to improve the wire printers of the general type above specified by providing an electromagnet design requiring only a minimum of space in the direction of the printing wires and allowing a very compact design of the printer as a whole. Another object is the provision of a wire printer composed of simple and inexpensive parts which can be assembled quickly and easily to form a printer unit.

SUMMARY OF THE INVENTION

According to a principal feature of the invention, each of the electromagnet cores referred to consists of a substantially plane strip the plane of which forms right angles with the printing wires, and each of the armatures referred to consists of a strip having a flat main portion, a rear portion bent towards the rear end of the core strip, and a front portion offset towards the core to form a pole face separated from the front end of the core by an air gap.

The invention is primarily concerned with printers in which the axes of the printing wires define a common plane at right angles to the planes of the core strips, said plane being preferably parallel to a plane defined by the front edges of the offset portions of the armature strips. The invention also includes wire printers in which the guide means provided at the front ends of the wires define a two-dimensional array (as required for the printing of a whole sign or character at the same time), provided that the cross-sectional width of said array is not too large.

In a preferred form of the invention, the core strips are attached to and supported by at least one rod extending through holes in the rear parts of the core strips.

In a twin printer (or multiple printer) device according to the invention having at least two groups of printing wires and at least two corresponding rows of electromagnets, each of the core strips of one row is connected at its rear end to a core strip of the other row by a yokepiece integral with said strips.

Other objects, features and advantages of the invention will appear from the following description of a specific embodiment of the invention as illustrated in the accompanying drawings.

DRAWINGS

FIG. 1 is a perspective view of a wire printer in accordance with the invention, FIG. 2 is an exploded perspective view of part of the wire printer shown in FIG. 1, and, FIG. 3 is an enlarged view of a detail of FIG. 2.

DESCRIPTION OF THE EMBODIMENTS

Figure 1:
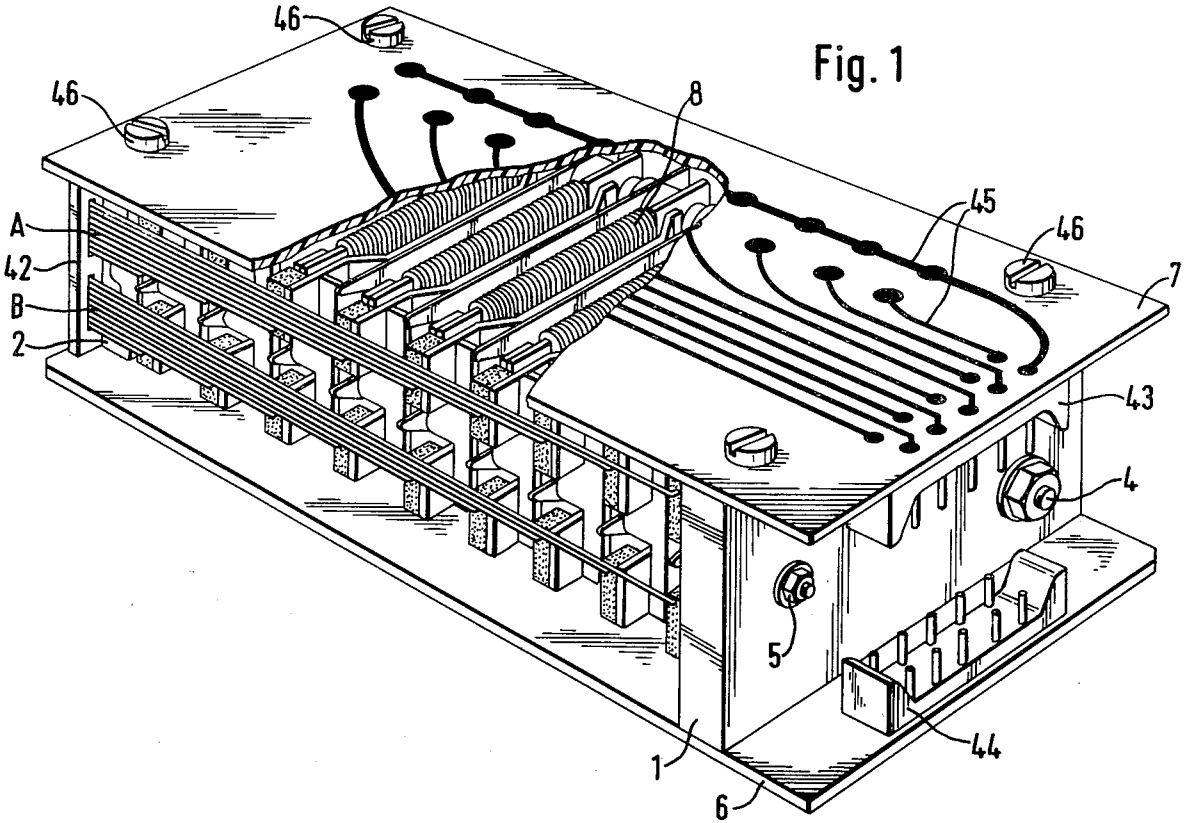
Figures 2, 3:
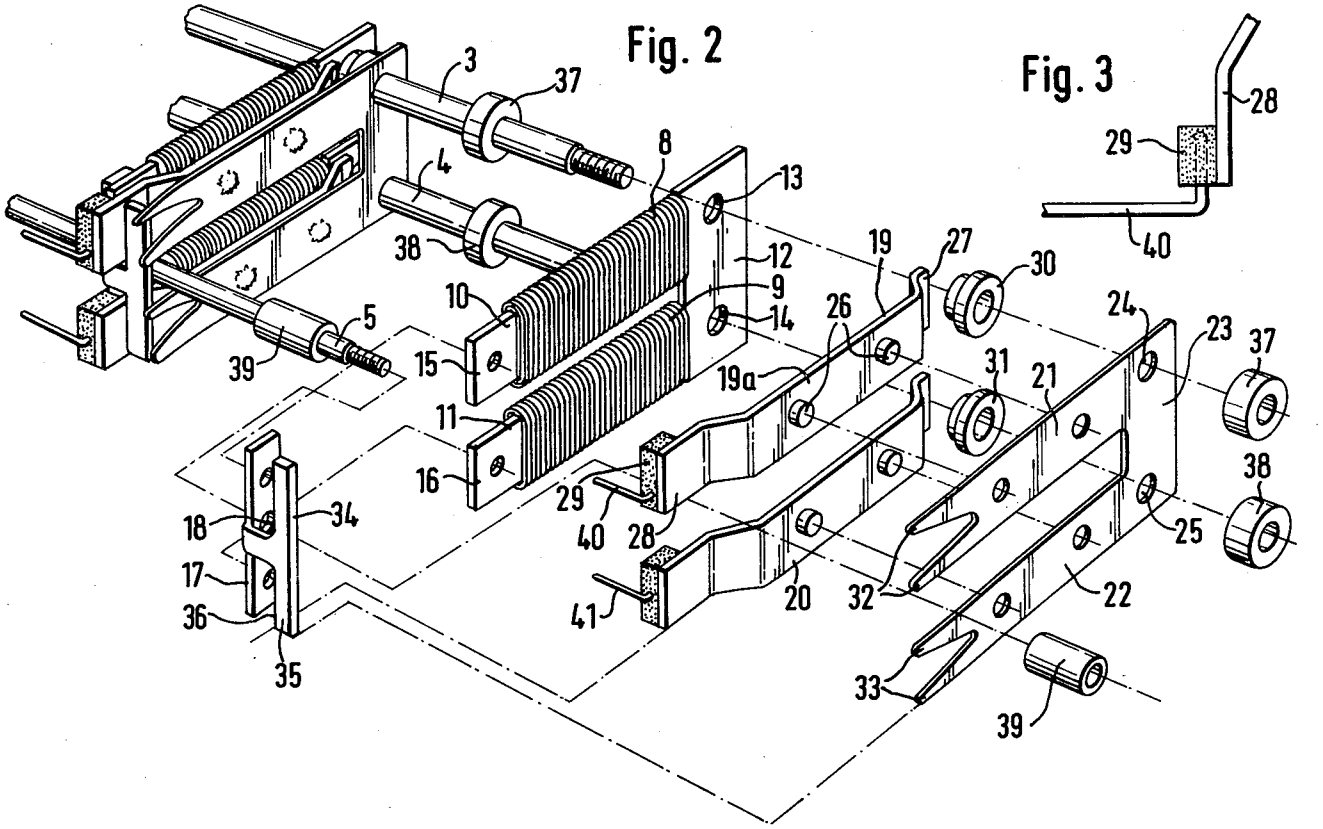

The wire printer shown has a frame consisting of a pair of end plates 1, 2 joined by three parallel rods 3, 4, 5. A base plate 6 and a top plate 7 are attached to the end plates by screws 46. The three rods 3, 4, 5 support two rows of operating magnets consisting each of nine operating magnets, each of the magnets of one row being located directly above a magnet of the other row. Each of the operating magnets has a core provided with a winding 8, 9 and consisting of one shank 10, 11, respectively of a U-shaped core sheet the yoke portion 12 of which is provided with holes 13, 14 for the rods 3, 4 respectively. The front ends 15, 16 of the core strips 10, 11 are joined by a strip 17 of nonmagnetic material provided with a hole 18 for the rod 5. Each of the core strips 10, 11 cooperates with a strip-shaped armature 19, 20, respectively, supported by one shank 21, 22, respectively, of a U-shaped sheet of spring material, for instance spring steel or beryllium bronze. The yoke portion 23 of said U-shaped sheet is provided with holes 24, 25 for the rods 3, 4, respectively. As the armature strips 19, 20 are identically similar, it will be sufficient to describe one armature strip 19. The strip has a flat main portion 19*a* attached to the spring shank 21 by means of a pair of rivets 26, a rear portion 27 bent towards the yoke portion 12 of the core, and a front portion 28 offset towards the front end 15 of the core strip 10. A part of said front portion 28 extends beyond the front edge of the core strip 10 and supports a pad 29 of an elastic material, for instance synthetic rubber, attached thereto by means of an adhesive. The yoke portion 12 of the core sheet and the yoke portion 23 of the spring member are separated by a pair of annular spaces 30, 31 ensuring that the rear portion 27 of the armature strip 19 and the corresponding end portion of the armature strip 20 lightly engage or are separated by a very narrow air gap only from the yoke portion 12 joining the core strips 10, 11.

Each of the spring shanks 21, 22 is provided at its front end with a pair of spring tongues 32, 33, respectively, engaging one edge 34 of a strip-shaped rest member 35 integral with the strip 17 joining the front ends of the core strips. The opposed edge 36 of the rest member 35 serves as a stop member for the front portion 28 of the armature strip 19 and the corresponding portion of the armature strip 20. When the winding 8 of the core strip 10 is not energized, the spring tongues 32 will keep the front portion of the armature strip 19 in engagement with the edge 36 of the rest member 35. Spacer rings 37, 38 on the rods 3, 4, respectively, and spacing sleeves 39 on the rod 5 determine the axial spacing of the electromagnet units described.

Energization of the winding 8 causes a magnetic flux to flow in a closed magnetic circuit from the front end 15 of the core strip 10 through the core strip 10, the adjoining part of the yoke 12, the rear portion 27 of the armature strip 19, the main portion 19*a* and the front portion 28 of said armature strip back to the front end 15 of the core strip 10. The magnetic attraction then occurring between the front portion 28 of the armature strip 19 and the front end of the core strip causes the armature strip 19 to turn about the flexible joint formed by the rear part of the spring shank 21 and the adjoining part of the yoke portion 23 of the spring member, so that the front portion 28 of the armature strip will strike the front end 15 of the core strip (preferably provided with a nonmagnetic insert for preventing magnetic tacking).

It will be clear from the above description that each of the magnet units described, comprising a U-shaped core member 10, 11, 12, a winding 8, 9 on each of the shanks 10, 11, a pair of armature strips 19, 20 and a U-shaped spring member 21, 22, 23, forms two operating magnets operating independently of each other. The nine armature strips of the upper row each operate one of the printing wires of an upper group A of nine printing wires. The nine operating magnets of the lower row each operates one of the printing wires of a lower group B of nine wires. Each of said groups of printing wires is guided at its front end by a slot in a guide plate 42 adjacent to the record medium which is to receive the inprints, for instance a paper strip supported by a backing member. The wire groups extend backwards from said guide slots along the front edges of the armature strips 19, 20. Thus, the axes of the wires define a common plane parallel to said front edges. The rear end of each of the wires is bent at right angles to the wire and stuck into the elastic pad 29 of the corresponding electromagnet. This arrangement provides a playfree connection of the armature strip to the printing wire. The pad 29 also serves as a vibration-dampener to the wire connected thereto.

The windings 8, 9 of the operating magnets are connected through conductors 45 to sockets 43, 44, one socket being provided for each of the two rows of operating magnets. A corresponding contact plug and cable (not shown) connects each of the sockets 43, 44 to an operating unit arranged to transmit printing pulses to selected magnets at intervals determined by the rate of advancement of the record medium with respect to the printer. Operating units of this kind are well known and require no further description. The arrangement shown and described allows the simultaneous printing of two rows of characters on one and the same or two separate character carriers.

The printing wires may have any desired cross-sectional shape, for instance a massive round, tubular or U-shaped cross-sectional shape.

I claim:

1. A wire printer comprising an operating magnet assembly comprising a plurality of flat, uniformly spaced core elements, each of which consists of a yoke member and at least two parallel, strip-shaped shank members integral with said yoke member, an energizing winding on each of said shank members, said winding surrounding a portion of the shank extending between said yoke member and a projecting pole end of said shank, an armature member for each of said shank member, said armature member extending along the shank member and having a rear end magnetically connected to said yoke member and a front portion opposed to the projecting pole end of the shank member, means for supporting each of said armature members for pivotal motion with respect to the shank member, a biasing spring for each of said armature members tending to move the front portion of the armature member away from the pole end of the shank member, a plurality of printing wires each corresponding to one armature member, said printing wires being substantially straight and parallel and extending at right angles to the planes of said flat core elements, means for guiding the printing ends of said printing wires for longitudinal movement towards and away from a printing station, and means for connecting each of said printing wires to the front end of a corresponding one of the armature members.

2. A wire printer as claimed in claim 1, in which said printing wires are arranged substantially in a common plane slightly spaced from the free edges of the armature members.

3. A wire printer as claimed in claim 2, in which the printing wires connected to each of the rows of armature members form a group within which the spacing of the printing wires is less than the spacing between adjacent groups of printing wires.

4. In a wire printer of the type comprising a group of substantially straight and substantially parallel printing wires, means for guiding the printing ends of said wires for longitudinal movement towards and away from a printing station, a group of electromagnets comprising one electromagnet for each of said printing wires, means for supporting said electromagnets in a row extending along said group of printing wires, each of said electromagnets comprising a core extending at right angles to the printing wires and having a front end adjacent to said group of printing wires and a rear end remote from said group of printing wires, a winding on said core, an armature extending along said core, means for pivotally connecting said armature to the rear end of said core, a biasing spring tending to move the armature away from the front end of the core, and means for connecting the front end of the armature to the rear end of a corresponding one of said printing wires for imparting said longitudinal movement thereto, the improvement characterized in that each of said cores consists of a substantially plane strip the plane of which forms right angles with the printing wires, and that each of said armatures consists of a strip having a flat main portion, a rear portion magnetically connected to the rear end of the core strip, and a front portion offset towards the core to form a pole face separated from the front end of the core by an air gap, and that the printer comprises at least two groups of printing wires and at least two corresponding rows of electromagnets, each of the core strips of one row being connected at its rear end to a core strip of the other row by a yoke-piece integral with the strips.

5. A wire printer comprising a group of substantially straight and substantially parallel printing wires, means for guiding the printing ends of said wires for longitudinal movement towards and away from a printing station, a group of electromagnets comprising one electromagnet for each of said printing wires, means for supporting said electromagnets in a row extending along said group of printing wires, each of said electromagnets comprising a core consisting of a substantially plane and substantially straight strip the plane of which and the longitudinal axis of which form right angles with the printing wires, said strip having a front end adjacent to said group of printing wires and a rear end remote from said group of printing wires, a winding on said core, an armature extending along said core, said armature consisting of a strip having a flat main portion, a rear portion magnetically connected to the rear end of the core strip, and a front portion offset towards the core to form a pole face separated from the front end of the core by an air gap, means for pivotally connecting said armature to the rear end of the core, means for connecting the front end of the armature to the rear end of a corresponding one of said printing wires for imparting said longitudinal movement thereto, a flat biasing spring tending to move the armature away from the front end of the core, said flat biasing spring being attached to the flat main portion of the armature strip at the side of said strip facing away from the core strip and having a front extremity extending beyond said flat main portion, each of said core strips being provided with a rest member for said front extremity of the flat biasing spring, said rest member being rigidly attached to the front end of the core strip and being arranged to engage the side of the spring engaging the armature strip, and a stop member for limiting the movement of the armature away from the core, said stop member being integral with said rest member.

* * * * *